US005626075A

United States Patent [19]

Detmers et al.

[11] Patent Number: 5,626,075

[45] Date of Patent: May 6, 1997

[54] SHEET GUIDING CYLINDER

[75] Inventors: Andreas Detmers, Mauer; Joachim Herrmann, Mannheim, both of Germany

[73] Assignee: Heidelberger Druckmaschinen AG, Heidelberg, Germany

[21] Appl. No.: 373,026

[22] Filed: Jan. 17, 1995

[30] Foreign Application Priority Data

Jan. 17, 1994 [DE] Germany ..... 44 01 114.8

[51] Int. Cl.[6] ..... B41F 13/24

[52] U.S. Cl. ..... 101/232; 271/276; 271/204; 271/246; 101/409; 101/420

[58] Field of Search ..... 101/408, 409, 101/410, 407.1, 420, 216, 217, 232, 231, 246; 271/195, 276, 306, 82, 204

[56] References Cited

U.S. PATENT DOCUMENTS 4,815,379 3/1989 Becker et al. ..... 101/246

5,419,254 5/1995 DeMoore et al. ..... 101/420

5,456,178 10/1995 Henn et al. ..... 101/409 X

FOREIGN PATENT DOCUMENTS 4223839 12/1993 Germany .

*Primary Examiner*—Christopher A. Bennett

*Attorney, Agent, or Firm*—Herbert L. Lerner; Laurence A. Greenberg

[57] ABSTRACT

Sheet guiding cylinder of a printing press includes a cylinder casing rotatable about an axis of rotation, and having an outer cylindrical surface defining a skeletal framework; the skeletal framework being formed by guide vanes extending in longitudinal direction of the sheet guiding cylinder and having a curved guide vane profile disposed in planes perpendicular to the axis of rotation, the guide vanes beginning from respective locations radially inward from the outer cylindrical surface and terminating substantially radially in an imaginary cylindrical envelope surface enveloping the outer cylindrical surface and being symmetrical with the axis of rotation.

2 Claims, 3 Drawing Sheets

SHEET GUIDING CYLINDER

BACKGROUND OF THE INVENTION

FIELD OF THE INVENTION

The invention relates to a further development of a sheet guiding cylinder described in German Patent 42 23 839. A particular use for this sheet guiding cylinder of the German patent is in a chain delivery of a sheet-fed rotary printing press, wherein the sheet guiding cylinder directly follows an impression cylinder. In this regard, the sheet guiding cylinder is located between two chain or sprocket wheels which are concentric to or coaxial with the axis of rotation thereof. A pair of endless delivery chains are slung around the chain wheels and convey, out of the region of the impression cylinder to a sheet pile stacking device, gripper systems carried by the delivery chains, together with sheets coming from the impression cylinder and clamped by the gripper systems. It is thus a task of the sheet guiding cylinder to guide a sheet, respectively, clamped in a gripper system along a conveying path defined by the chain wheels, in such a manner that the print quality of a freshly printed surface facing the sheet guiding cylinder is not diminished by so-called smudging or smearing.

Moreover, the aforementioned heretofore known sheet guiding cylinder is provided with an air cushion for supporting the respective sheet and keeping it away from the outer cylindrical surface of the sheet guiding cylinder during operation. This air cushion is formed by an air flow emerging from a vane ring. The vanes of the vane ring have a curved profile. Thus, one may expect from the aforementioned sheet guiding cylinder of the German patent that, when the formation or design of the curves of the vane profile are advantageous in air flow technology, a favorable relationship between the power supplied to the drive of the vane ring, on the one hand, and the kinetic energy inherent in the air flow emerging from the vane ring, on the other hand, can be achieved. Such an optimization in air flow technology, however, does not generally ensure that a respective sheet will be kept reliably away from the outer cylindrical surface of the sheet guiding cylinder. Operational conditions may arise wherein an opposite effect may occur, namely, a sheet may be pressed against the outer cylindrical surface of the sheet guiding cylinder due to a reduced static pressure created in the vicinity of the sheet and the sheet guiding cylinder due to the effect of air flow emerging from the vane ring. Such operational conditions can be caused, for example, by a change in the mechanical properties of the sheets and by a deviation of the speeds of travel of the sheets from the production speed.

SUMMARY OF THE INVENTION

It is accordingly an object of the invention to provide an improvement in the sheet guiding cylinder known heretofore from the aforementioned German patent which prevent the sheets from being pressed against the outer cylindrical surface of the sheet guiding cylinder, when operating conditions vary.

With the foregoing and other objects in view, there is provided, in accordance with the invention, a sheet guiding cylinder of a printing press, comprising a cylinder casing rotatable about an axis of rotation, and having an outer cylindrical surface defining a skeletal framework, the skeletal framework being formed by guide vanes extending in longitudinal direction of the sheet guiding cylinder and having a curved guide vane profile disposed in planes perpendicular to the axis of rotation, the guide vanes beginning from respective locations radially inward from the outer cylindrical surface and terminating substantially radially in an imaginary cylindrical envelope surface enveloping the outer cylindrical surface and being symmetrical with the axis of rotation.

In accordance with a concomitant aspect of the invention, there is provided a sheet guiding cylinder of a printing press, comprising a cylinder casing rotatable about an axis of rotation and having end face parts formed with openings, and an outer cylindrical surface defining a skeletal framework, a first rotary drive member for operationally rotating the cylinder casing about the axis of rotation, a vane ring disposed within the cylinder casing concentric to the axis of rotation and rotatable about the axis of rotation relative to the cylinder casing, the vane ring being formed with vanes extending in longitudinal direction of the sheet guiding cylinder and having a curved vane profile disposed in planes perpendicular to the axis of rotation, the vane ring surrounding a suction region extending in longitudinal direction of the sheet guiding cylinder and communicating with the respective openings of the respective end face parts, and a second rotary drive member for operationally rotating the vane ring relative to the cylinder casing, the skeletal framework defined by the outer cylindrical surface being formed by guide vanes extending in longitudinal direction of the sheet guiding cylinder and having a curved guide vane profile disposed in planes perpendicular to the axis of rotation, the guide vanes beginning from within the outer cylindrical surface and terminating substantially radially in an imaginary cylindrical envelope surface enveloping the outer cylindrical surface and being symmetrical with the axis of rotation.

When a sheet guide cylinder according to the invention of the instant application is placed in operation, an air flow employed for creating the aforementioned air cushion, in the section of the air flow where it impacts on the respective sheet, has a considerably greater radial component when compared with the aforedescribed conventional sheet guide cylinder. A result thereof, accordingly, is that stable operation is assured in the sense that a respective sheet is kept away from the outer cylindrical surface of the sheet guiding cylinder, even when a change in an operational condition corresponding to the aforementioned examples has occurred. An additional advantage is that, especially at the vane ring within the cylinder casing, loss of air flow can be reduced to a minimum through a suitable construction of the vane profile, without taking into account the directional components of the air flow leaving the vane ring. The construction of the skeleton or framework forming the outer cylindrical surface of the cylinder can likewise be such as to minimize loss of air flow at the guiding vanes. Thus, with a sheet guiding cylinder according to the invention, stable operation in the sense described hereinbefore can be achieved without having to expend much additional energy for driving the air flow-generating vane ring.

Other features which are considered as characteristic for the invention are set forth in the appended claims.

Although the invention is illustrated and described herein as embodied in a sheet guiding cylinder, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings, in which:

DESCRIPTION OF THE PREFERRED EMBODIMENTS

Figure 1:
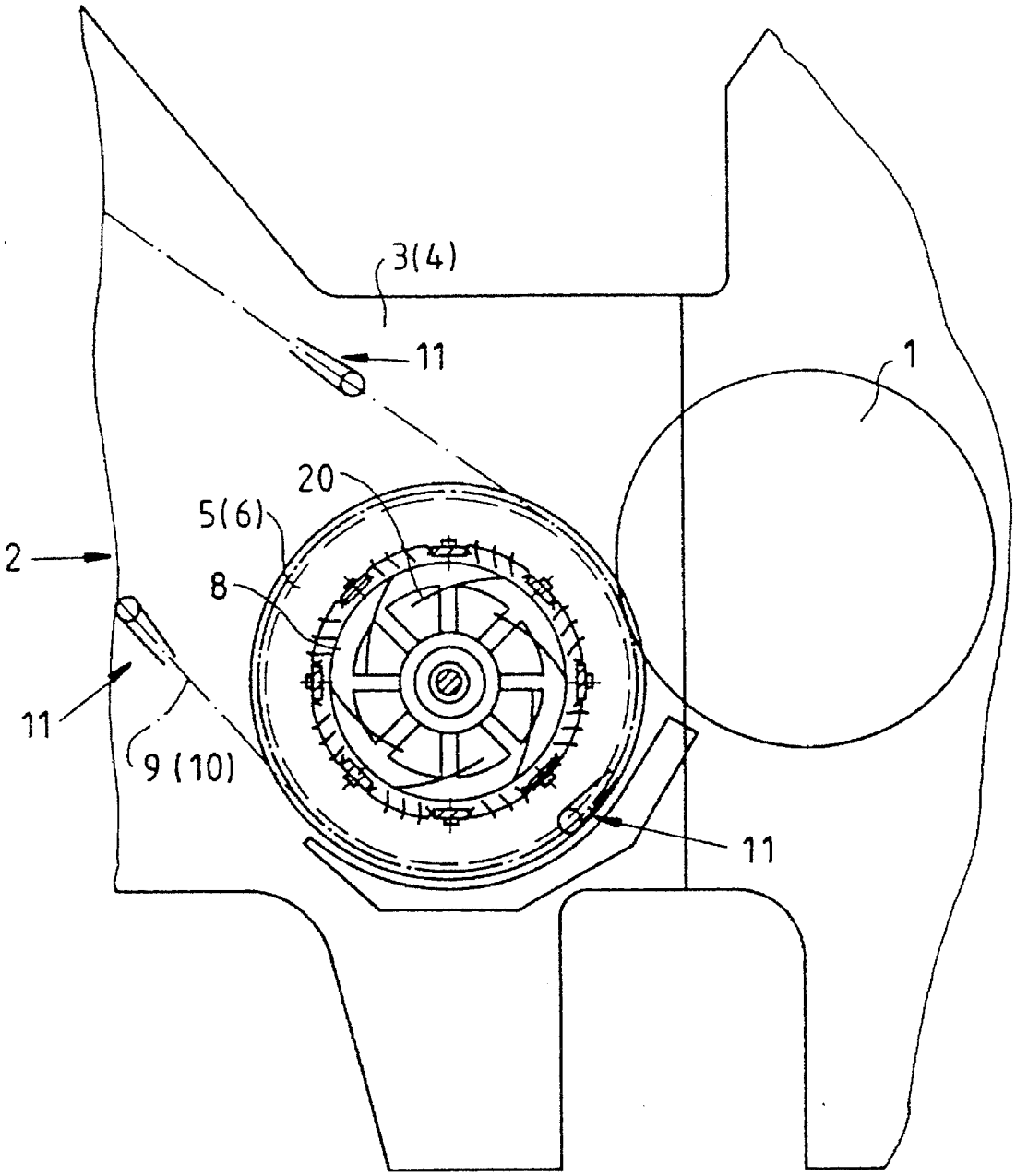
FIG. 1 is a fragmentary diagrammatic side elevational view of a sheet-fed rotary printing press having a sheet guiding cylinder integrated in a chain delivery of the printing press in accordance with the invention.

Referring now to the drawing and, first, particularly to FIG. 1 thereof, there is shown diagrammatically therein a section of a sheet-fed rotary printing press with an impression cylinder 1 followed by a section of a chain delivery 2. The chain delivery 2 includes a first chain or sprocket wheel 5 carried by a first side wall 3, and a second chain or sprocket wheel 6 carried by a second side wall 4. The chain wheels 5 and 6 are rotatable about an axis of rotation 7 (note FIG. 2) of a sheet guiding cylinder 8 arranged therebetween, and a pair of endless delivery chains 9 and 10 are slung or wound around the chain wheels 5 and 6. The delivery chains 9 and 10 carry and convey gripper systems 11, and sheets coming from the impression cylinder 1 are clamped by the gripper systems 11 and conveyed therewith out of the region of the impression cylinder 1 to a non-illustrated sheet-pile stacking device. In the interest of clarity, the aforementioned sheets are not shown in the drawings.

Figure 2:
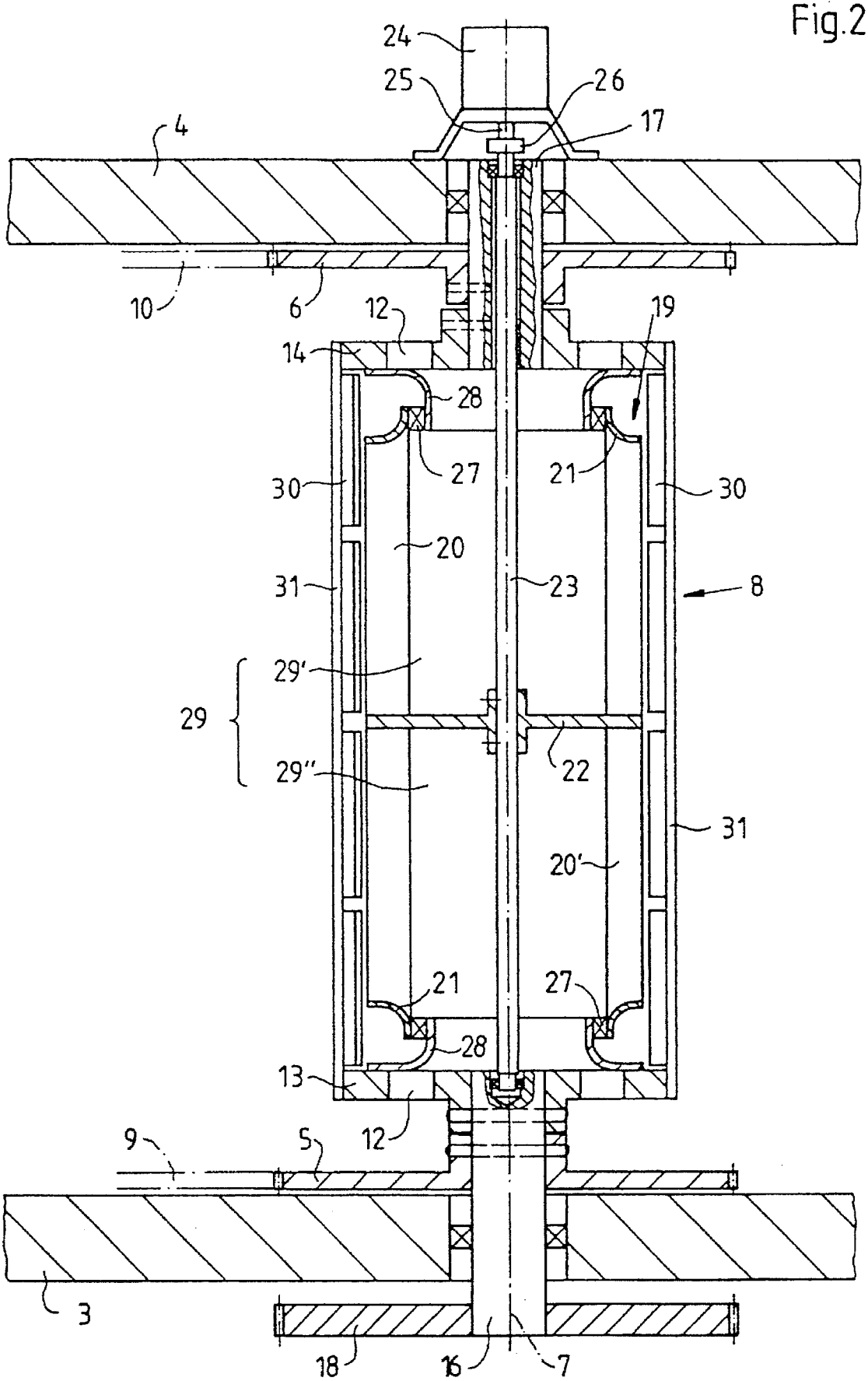
FIG. 2 is a slightly enlarged, horizontal cross-sectional view of FIG. 1 taken through the axis of rotation of the sheet guiding cylinder according to the invention.
Figure 3:
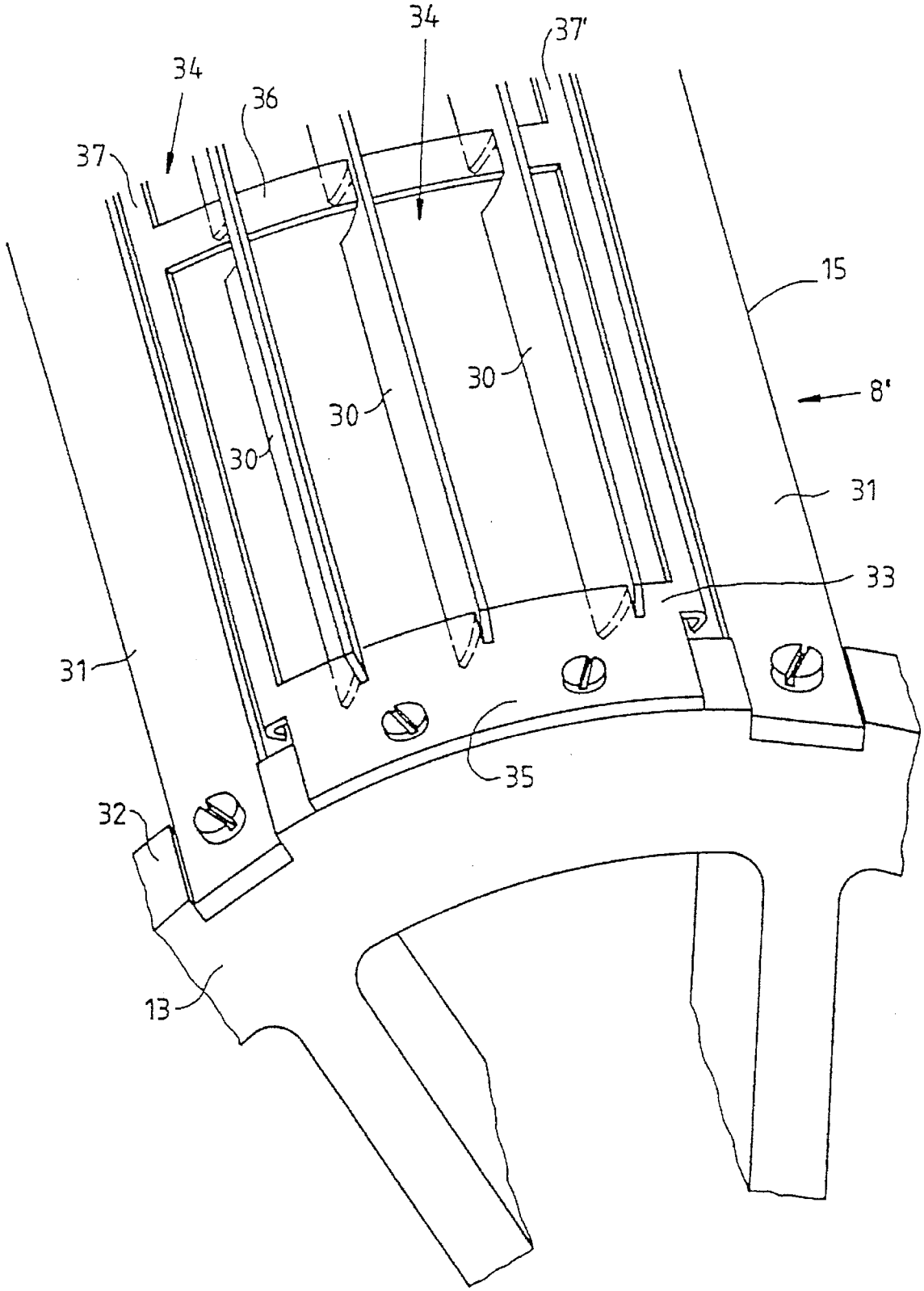
FIG. 3 is an enlarged fragmentary perspective view of FIG. 2, showing part of the cylinder casing of the sheet guiding cylinder according to the invention.

As is apparent in connection with FIGS. 2 and 3, the sheet guiding cylinder 8 has a cylinder casing 8' made up of end face parts 13 and 14 formed with perforations or openings 12 and an outer cylindrical surface 15 defining a skeletal framework surrounding the axis of rotation 7. A respective shaft section 16, 17, which is concentric to or coaxial with the axis of rotation 7, is fixedly connected with the respective end face parts 13 and 14, the shaft sections 16 and 17 being respectively mounted in the first and second side walls 3 and 4 so as to be rotatable about the axis of rotation 7. Furthermore, the respective chain wheels 5 and 6 are fixedly connected to the respective shaft sections 16 and 17. The operational rotation of the cylinder casing about the axis of rotation 7 is effected by means of a first rotary drive member 18 in the form of a gear wheel which, in the illustrated exemplary embodiment, is fixedly connected to the shaft section 16. This gear wheel which represents the first rotary drive member 18 can be, moreover, conventionally part of a gear wheel train of the sheet-fed rotary printing press, which is connected to a drive aggregate. In accordance with the exemplary embodiment described herein, the sheet guiding cylinder 8 and the chain wheels 5 and 6, together, are rotated about the axis of rotation 7 by means of the gear wheel train, during operation.

As is further apparent from FIGS. 1 and 2, a vane ring 19 concentric to or coaxial with the axis of rotation 7 and rotatable about the axis of rotation 7 relative to the cylinder casing 8' is provided within the cylinder casing 8'. The vane ring 19 is formed with vanes 20 and 20' which extend in axial direction along the width or breadth of the sheet guiding cylinder 8 and have a curved vane profile disposed in respective planes extending perpendicularly to the axis of rotation 7.

In the illustrated exemplary embodiment of FIGS. 2 and 3, the unified structure of the vane ring 19 is realized as follows: a respective vane 20, 20' extends in the axial direction of the sheet guiding cylinder 8 from a first vane end facing towards the respective end face part 13, 14 to a second vane end located approximately in the axial center of the sheet guiding cylinder 8. The respective first vane ends are fastened to a respective ring 21 which is concentric to or coaxial with the axis of rotation 7, and the respective second vane ends are fastened to a circular disk 22 which is also concentric to or coaxial with the axis of rotation 7.

Revolvability of the vane ring 19 about or with respect to the axis of rotation 7 relative to the cylinder casing 8 is realized in the exemplary embodiment as follows: a drive shaft 23 which is concentric to or coaxial with the axis of rotation 7 is rotatably mounted or journalled at the ends thereof in a respective one of the shaft sections 16 and 17, and is, furthermore, fixedly connected to the circular disk 22, as indicated diagrammatically by short horizontal lines representing respective bolts or screws in FIG. 2.

For operationally revolving or rotating the vane ring 19, a second rotary drive member 25 is provided which is represented in the exemplary embodiment illustrated in FIG. 2 as a stub shaft of a preferably controllable motor 24 mounted in the second side wall 4, the second rotary drive member 25 being connected to one end of the drive shaft 23 by means of a coupling 26.

In order to achieve a smooth operation of the vane ring 19 during its rotation relative to the cylinder casing, as shown in the illustrated exemplary embodiment, a respective ring 21 is braced, via a respective bearing ring 27, against the cylinder casing 8. The respective bearing rings 27 thereby embrace respective inlet nozzles 28, which are disposed concentric to or coaxial with the axis of rotation 7, are fastened to the respective end face parts 13 and 14 and extend into the interior of the cylinder casing 8. If necessary or desirable, such a bearing arrangement could be dispensed with.

An air flow generated by the rotation of the vane ring 19 penetrates through the openings 12 formed in the end face parts 13 and 14 into the interior defined by the outer cylindrical surface 15, and then passes into a suction region 29 which is surrounded by the vane ring 19 and extends in longitudinal direction of the sheet guide cylinder 8. In the exemplary embodiment of FIG. 2, this suction region 29 is divided by the circular disk 22 into two suction subregions 29' and 29", which are respectively connected, via the respective inlet nozzles 28, to the respective openings 12 of the respective end face parts 13 and 14.

Clearly seen in FIG. 3 is a construction in accordance with the invention wherein the outer cylindrical surface 15 of the sheet guide cylinder 8 defines a framework or skeleton using the guide vanes 30. In this embodiment of the invention, part of the skeleton or framework is represented by traverses or crossties 31 which connect the first end face part 13 to the second end face part 14 which is not shown in FIG. 3. The respective end face parts 13 and 14 are essentially formed as disks and have a circumferential surface 32 like that of the outer cylindrical surface, and the traverses 31 are distributed over the circumference of the respective discs. A frame 33 is inserted into a respective space formed between adjacent traverses 31 and is connected to the respective end face parts 13 and 14. The respective frames 33 are essentially formed of a thin-walled, hollow cylindrical segment provided with recesses 34 and extending from the first end face part 13 to the second end face part 14, the respective frames 33 being curved in such a manner that a respective end part 35 of the respective frames 33 associated with the respective end face parts 13 and 14 adapts to or hugs the respective circumferential surface 32 of the end face parts 13 and 14, respectively. The recesses 34 extend in the longitudinal direction of the outer cylindrical surface 15 from the first end part 35 to the second end part 35 (not shown in FIG. 3) of the frame 33 and are separated or delimited from one another in the longitudinal direction of the outer cylindrical surface 15 by means of bars 36 extending in circumferential direction of the hollow cylindrical segment forming the respective frame 33, each of the respective recesses 34 extending in circumferential direction of the outer cylindrical surface 15 from a first frame bar 37 to a second frame bar 37', the frame bars 37 and 37', in turn, extending in the longitudinal direction of the outer cylindrical surface 15 from the first to the second end part 35 of the frame 33, thus, forming a respective end section of the hollow cylindrical segment in the circumferential direction of the outer cylindrical surface 15.

The guide vanes 30 forming a further portion of the skeleton or framework are then inserted into the recesses 34 of the totality of the frames 33 assembled between the adjacent traverses 31. The guide vanes 30 extend from a first to a second end part 35 of the respective frames 33 and, thus, in the longitudinal direction of the sheet guiding cylinder 8. In planes extending perpendicularly to the axis of rotation 7, a respective guide vane 30 exhibits a guide vane profile. In the illustrated embodiment of FIG. 3, a respective guide vane profile extends from an imaginary first outer cylindrical surface disposed within the totality of the hollow cylindrical segments and symmetrical with the axis of rotation 7 to an imaginary second outer cylindrical surface disposed outside the totality of the hollow cylindrical segments and symmetrical with the axis of rotation 7, the imaginary second outer cylindrical surface representing an envelope surface surrounding the outer cylindrical surface 15. The guide vane profile and the position of the guide vanes 30 relative to a respective frame 33 are so selected that a respective outer profile section of the guide vane profile lying outside of the totality of the hollow cylindrical segments terminates substantially radially in the envelope surface. The remaining portion of the guide vane profile is preferably curved to such a degree that an inner profile section of the guide vane profile facing away from the outer profile section tends to be directed opposite to or against the direction of rotation of the vane ring 19.

In the exemplary embodiment of the invention illustrated in the figures herein, the guide vanes 30, in the vicinities of the end parts 35 of the frame 33 and the bars 36, are provided with releases which are mounted on the end parts 35 and the bars 36. Mutual fixation of the guide vanes 30, on the one hand, and the frame 33, on the other hand, can be effected by welding, provided that suitable manufacturing material had been previously selected. By means of such a mutual fixation, the skeleton or framework parts formed of the respective guide vanes 30 and a respective frame 33 appear as shown in FIG. 3, these skeleton or framework parts being connectable with the respective end face parts 13 and 14 by means of a screw connection at the circumferential surface 32 of the respective end face parts 13 and 14.

We claim:

1. Sheet guiding cylinder of a printing press, comprising a cylinder casing rotatable about an axis of rotation, and having an outer cylindrical surface defining a skeletal framework enclosing an interior within the sheet cylinder; a vane ring disposed in the interior of the sheet guiding cylinder for effecting an air flow through said skeletal framework; said skeletal framework including guide vanes extending in a longitudinal direction of the sheet guiding cylinder and having a curved guide vane profile disposed in planes perpendicular to said axis of rotation, said guide vanes beginning from respective locations radially inward from said outer cylindrical surface and terminating substantially radially in an imaginary cylindrical envelope surface enveloping said outer cylindrical surface and being symmetrical with said axis of rotation.

2. Sheet guiding cylinder of a printing press, comprising a cylinder casing rotatable about an axis of rotation and having end face parts formed with openings, and an outer cylindrical surface defining a skeletal framework; a first rotary drive member for operationally rotating said cylinder casing about said axis of rotation; a vane ring disposed within said cylinder casing concentric to said axis of rotation and rotatable about said axis of rotation relative to said cylinder casing, said vane ring being formed with vanes extending in longitudinal direction of the sheet guiding cylinder and having a curved vane profile disposed in planes perpendicular to said axis of rotation, said vane ring defining a suction region within said sheet guiding cylinder, said suction region extending in longitudinal direction of said sheet guiding cylinder and communicating with the respective openings of the respective end face parts; and a second rotary drive member for operationally rotating said vane ring relative to said cylinder casing, said skeletal framework defined by said outer cylindrical surface including guide vanes extending in a longitudinal direction of the sheet guiding cylinder and having a curved guide vane profile disposed in planes perpendicular to said axis of rotation, said guide vanes beginning from within said outer cylindrical surface and terminating substantially radially in an imaginary cylindrical envelope surface enveloping said outer cylindrical surface and being symmetrical with said axis of rotation.

* * * * *